US009834012B2

(12) United States Patent
Fukumoto et al.

(10) Patent No.: US 9,834,012 B2
(45) Date of Patent: Dec. 5, 2017

(54) INK JET METHOD AND INK JET APPARATUS

(71) Applicant: Seiko Epson Corporation, Tokyo (JP)

(72) Inventors: Hiroshi Fukumoto, Shiojiri (JP); Hiroaki Kida, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/669,986

(22) Filed: Mar. 26, 2015

(65) Prior Publication Data

US 2015/0273872 A1 Oct. 1, 2015

(30) Foreign Application Priority Data

Mar. 27, 2014 (JP) ..... 2014-066937

(51) Int. Cl.
*B41J 11/00* (2006.01)
*B41J 29/38* (2006.01)
*B41J 29/377* (2006.01)

(52) U.S. Cl.
CPC ..... *B41J 11/002* (2013.01); *B41J 29/377* (2013.01); *B41J 29/38* (2013.01)

(58) Field of Classification Search
CPC ..... B41J 11/002; B41J 11/0015; B41J 2/01; B41M 7/0072; C09D 11/101
See application file for complete search history.

(56) References Cited

U.S. PATENT DOCUMENTS 7,725,050 B2 * 5/2010 Li ..... B41J 29/377 347/17
2005/0041053 A1 * 2/2005 Hasebe et al. ..... 347/18
2007/0273739 A1 * 11/2007 Rodin ..... B41J 11/002 347/102
2008/0012891 A1 * 1/2008 Murashima ..... B41J 11/007 347/16
2009/0289999 A1 11/2009 Takahashi et al.
2010/0118095 A1 5/2010 Nakamura
2011/0015294 A1 1/2011 Kito et al.
2011/0102491 A1 * 5/2011 Kovacs et al. ..... 347/18
2011/0196057 A1 8/2011 Breton et al.
2012/0062666 A1 3/2012 Roof et al.
2012/0224005 A1 * 9/2012 Koase et al. ..... 347/51
(Continued)

FOREIGN PATENT DOCUMENTS

JP 2005-096415 A 4/2005
JP 2005-324443 A 11/2005
(Continued)

*Primary Examiner* — Shelby Fidler
(74) *Attorney, Agent, or Firm* — Nutter McClennen & Fish LLP; John J. Penny, Jr.; Alex Nagorniy

(57) ABSTRACT

Provided is an ink jet method including cooling an attachment body by a cooling device; ejecting an ultraviolet curable composition from an ejection head to the attachment body having a surface temperature of 45° C. or lower by the cooling device to be attached to the attachment body; and irradiating the ultraviolet curable composition attached to the attachment body with ultraviolet light and curing the ultraviolet curable composition, in which a viscosity of the ultraviolet curable composition attached to the attachment body when being subjected to the irradiating with the ultraviolet light at a surface temperature of the attachment body is 6 mPa·s or greater.

25 Claims, 3 Drawing Sheets

(56) References Cited

U.S. PATENT DOCUMENTS

| | | | | |
|---|---|---|---|---|
| 2013/0127962 | A1 | 5/2013 | Yoda | |
| 2013/0141505 | A1 | 6/2013 | Ikeda et al. | |
| 2013/0286120 | A1* | 10/2013 | Kobayashi | B41J 11/002 347/102 |
| 2014/0020624 | A1* | 1/2014 | Kovacs et al. | 118/641 |
| 2014/0267519 | A1* | 9/2014 | Suzuki | B41J 11/002 347/102 |
| 2014/0267521 | A1* | 9/2014 | Suzuki | B41J 11/04 347/102 |

FOREIGN PATENT DOCUMENTS

| | | | |
|---|---|---|---|
| JP | 4335955 | B1 | 9/2009 |
| JP | 2009-279830 | A | 12/2009 |
| JP | 2010-115791 | A | 5/2010 |
| JP | 2010-132007 | A | 6/2010 |
| JP | 2010-269471 | A | 12/2010 |
| JP | 2011-162786 | A | 8/2011 |
| JP | 2012-040760 | A | 3/2012 |
| JP | 2012-061852 | A | 3/2012 |
| JP | 2012-240240 | A | 12/2012 |
| JP | 2013-107275 | A | 6/2013 |

* cited by examiner

INK JET METHOD AND INK JET APPARATUS

BACKGROUND

1. Technical Field

The present invention relates to an ink jet method and an ink jet apparatus.

2. Related Art

In the related art, various kinds of methods are used as a recording method of forming an image based on an image data signal on a recording medium such as paper. Among them, since an image is formed directly on a recording medium by ejecting ink only to a required image portion by a cheap apparatus, the ink can be effectively used and the running cost is cheap. Further, since the ink jet method produces little noise, the ink jet method is excellent as a recording method.

Recently, according to an ink jet recording method using photocuring-type ink in which monomers are photopolymerized (cured) by being irradiated with light, an image having excellent water resistance and wear resistance can be formed on a recording surface of a recording medium, so the ink jet recording method is used for manufacturing color filters, performing printing (recording) on printed circuit boards, plastic cards, plastic sheets, large signboards, and plastic parts, printing barcodes and dates, and the like.

For example, Japanese Patent No. 4335955 discloses an energy ray curing-type ink composition containing a colorant, a polymerizable compound, a photoinitiator, and a surface adjusting agent, in which the polymerizable compound includes a monofunctional monomer having an acryl equivalent weight of 300 or less and one ethylene double bond in one molecule and multifunctional monomer having an acryl equivalent weight of 150 or less and two or more ethylene double bonds in one molecule, the photoinitiator contains the α-aminoalkylphenone-based compound and a thioxanthone-based compound, and the surface adjusting agent contains a silicon-based compound having a polydimethylsiloxane structure. Also, Japanese Patent No. 4335955 discloses a technique of obtaining a highly reactive ink composition with a low viscosity appropriate for an ink jet recording method by containing the polymerizable compound only including a monofunctional monomer having an acryl equivalent weight of 300 or lower, and a multifunctional monomer having an acryl equivalent weight of 150 or lower (Paragraphs 0006 and 0007 in Japanese Patent No. 4335955).

Here, when printing is performed by using the ink composition disclosed in Japanese Patent No. 4335955 with an ink jet printer, the temperature of a drum conveying a recording medium increases in accordance with prolonged continuous printing of the ink jet printer and the temperature of the recording medium increases. At this point, a problem of a generation of curing wrinkles of the recorded matter become worse. The cause has been examined to find out that as the viscosity of the ink when being attached to the surface of the recording medium and irradiated is lower, the generation of the curing wrinkles is greater. If the same composition of the ink is used, when the temperature of the ink when being irradiated with ultraviolet light is high and the viscosity of the ink is low, generation of curing wrinkles is greater. The increase of the temperature of the ink when being irradiated with ultraviolet light is mainly caused by the increase of the temperature of the recording medium. As the cause of the increase of the temperature of the recording medium, the heat generation of the light source, the heat generation of the head, the increase of the temperature of a drum due to curing heat when the ink on the recording medium is cured, and the like may be considered. The increase of the temperature of the recording medium is noticeable in a UV printer that performs continuous printing at high speed, such as a UV label recording device, especially, in a line printer.

SUMMARY

An advantageous of some aspects of of the invention is to provide an ink jet method and an ink jet apparatus that can reduce the generation of the curing wrinkles.

That is, the invention is as follows.

[1] According to an aspect of the invention, there is provided an ink jet method including: cooling an attachment body by a cooling device; ejecting an ultraviolet curable composition from an ejection head to the attachment body having a surface temperature of 45° C. or lower by the cooling device to be attached to the attachment body; and irradiating the ultraviolet curable composition attached to the attachment body with ultraviolet light and curing the ultraviolet curable composition, in which a viscosity of the ultraviolet curable composition attached to the attachment body when being subjected to the irradiating with the ultraviolet light at a surface temperature of the attachment body is 6 mPa·s or greater.

[2] In the ink jet method according to [1], the ultraviolet curable composition may not contain a tri- or higher-functional polymerizable compound, or in a case where the ultraviolet curable composition contains a tri- or higher-functional polymerizable compound, a content of the tri- or higher-functional polymerizable compound may be 20% by mass or less.

[3] In the ink jet method according to [1] or [2], a duration time in the attaching of the ultraviolet curable composition may be 20 minutes or greater.

[4] In the ink jet method according to any one of [1] to [3], the cooling device may be at least any one of a gas cooling type or a liquid cooling type.

[5] In the ink jet method according to any one of [1] to [4], a viscosity of the ultraviolet curable composition when being ejected from the ejection head is 15 mPa·s or less.

[6] In the ink jet method according to any one of [1] to [5], a temperature of the ultraviolet curable composition when being ejected from the ejection head may be 35° C. or higher.

[7] In the ink jet method according to any one of [1] to [6], an average polymerizable unsaturated double bond equivalent weight of the ultraviolet curable composition may be in a range of 50 to 200.

[8] In the ink jet method according to any one of [1] to [7], the ink jet method may be performed by one time of scanning of ejecting the ultraviolet curable composition from the ejection head while changing a relative position of the attachment body to the ejection head.

[9] In the ink jet method according to any one of [1] to [8], the curing of the ultraviolet curable composition may include irradiating the ultraviolet curable composition with ultraviolet light to temporarily cure the ultraviolet curable composition attached to the attachment body; and additionally irradiating the ultraviolet curable composition with ultraviolet light at least once to further cure the temporarily cured ultraviolet curable composition, and a viscosity of the ultraviolet curable composition attached to the attachment body at a surface temperature of the attachment body when being firstly irradiated with ultraviolet light for the temporary curing may be 6 mPa·s or greater.

[10] In the ink jet method according to any one of [1] to [9], an energy of the first ultraviolet light irradiation for temporary curing may be in a range of 1/12 to 1/20 of a total irradiation energy of second and subsequent ultraviolet light irradiation.

[11] In the ink jet method according to any one of [1] to [10], a light source used for the first irradiation for the temporary curing may be an ultraviolet light emitting diode having a peak wavelength in a range of 350 nm to 420 nm.

[12] According to another aspect of the invention, there is provided an ink jet apparatus that performs the ink jet method according to any one of [1] to [11].

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the invention are described in detail.

In an ink jet method according to the embodiment, an ultraviolet curable composition is used. First, the ultraviolet curable composition is described, and subsequently, respective processes included in the recording method are described.

Ink Jet Apparatus

The ink jet apparatus according to the embodiment is used in the ink jet method described below. In addition, in the invention, the configuration of the ink jet apparatus is not particularly limited.

Figure 1:
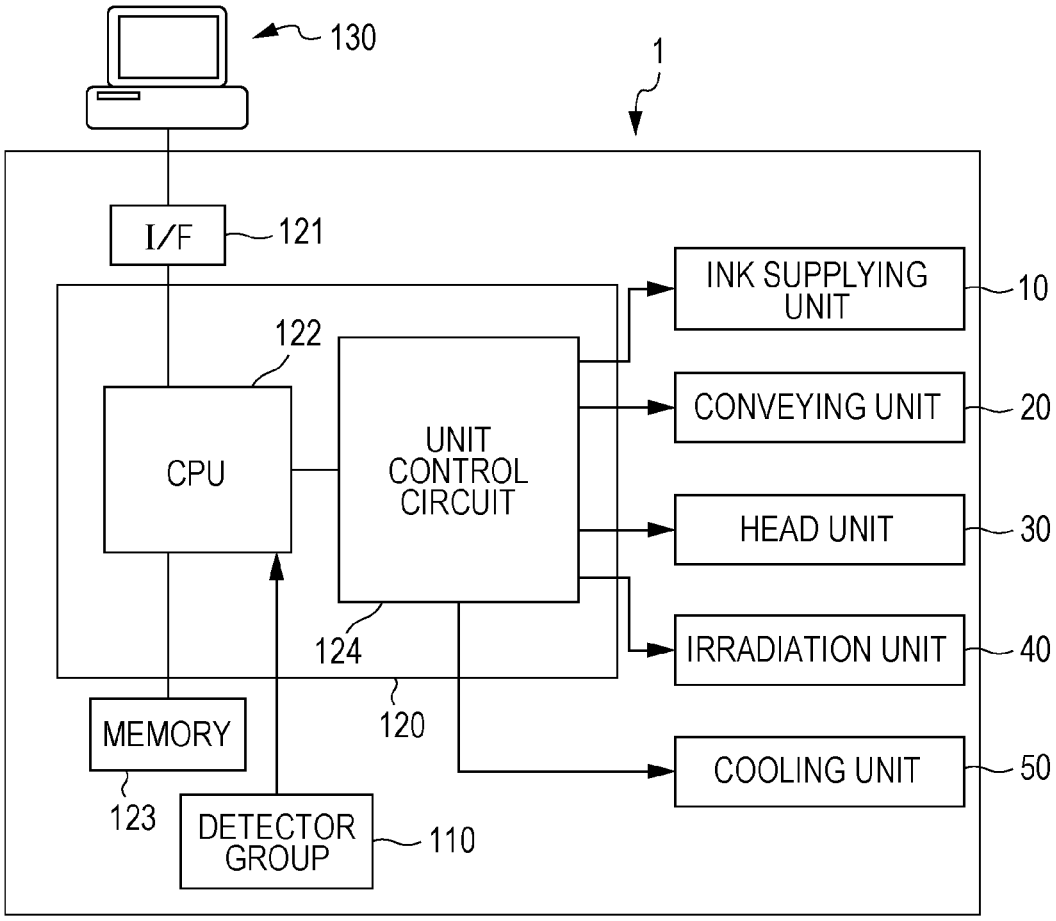
FIG. 1 is a block diagram illustrating an example of the configuration of an ink jet apparatus of the invention.

FIG. 1 is a block diagram illustrating an example of the configuration of an ink jet apparatus used in the embodiment. A printer driver is installed in a computer 130. In order to cause a printer 1 to record an image, the printer driver outputs print data corresponding to the image to the printer 1. The printer 1 corresponds to an "ink jet apparatus" of the invention. The printer 1 includes an ink supplying unit 10, a conveying unit 20, a head unit 30, an irradiation unit 40, a cooling unit 50, a detector group 110, a memory 123, an interface 121, and a controller 120. The controller 120 includes a CPU 122 and a unit control circuit 124. The printer 1 that receives print data from the computer 130, which is an external apparatus, controls respective units by the controller 120, and records an image on a recording medium according to the print data. The condition in the printer 1 is monitored by the detector group 110, and the detector group 110 outputs the detection result to the controller 120. The controller 120 controls respective units, and stores the print data input via the interface 121 in the memory 123 based on the detection result output from the detector group 110. The control information for controlling respective units is stored in the memory 123.

Ink Jet Head

The head unit 30 included in the ink jet apparatus (printer 1) includes heads (ink jet heads) that eject ink composition (ultraviolet curable composition) to the recording medium to perform recording. The heads include cavities that eject received ink composition from nozzles, ejection driving portions that are provided for respective cavities and apply driving force for ejection to ink, the nozzles that are provided for respective cavities and eject the ink composition to the outside of the heads, and a nozzle formed surface in which the nozzles are formed. One head may include the plural cavities and the plural ejection driving portions and the plural nozzles which are provided for respective cavities in a manner of being independent from each other. The ejection driving portion can be formed by using an electromechanical transducer such as a piezoelectric device that changes a capacity of a cavity by mechanical deformation, a thermoelectric conversion element that causes ink to generate bubbles by generating heat, and ejects the ink, and the like. The recording device may include one or plural heads for one ink color, and if the recording device includes plural heads, a line head may be configured by arranging the plural heads in line in a width direction of the recording medium. In this case, the width of the recording medium may be caused to be wide. When the recording is performed by using ink compositions of plural colors, the recording device includes heads for respective colors of ink. The heads may be configured, for example, in the same manner as in FIG. 3 of JP-A-2009-279830.

If the recording device is a line printer which is a line-type recording device, the recording device includes a line head having a length which is equal to or longer than the length corresponding to the width of the recording medium, as a head. While the line head and the recording medium are changing relative positions in a scanning direction intersecting to the width direction of the recording medium, the ink composition is ejected from the line head toward the recording medium. In the line printer, the heads are fixed with (almost) no movement and perform recording by one pass (single pass). The line printer is advantageous than a serial printer in that the recording speed is fast.

Meanwhile, the serial printer which is a serial recording device causes the heads to perform main scanning (pass) for ejecting the ink composition while the heads move in the main scanning direction intersecting to an auxiliary scanning direction of the recording medium, so that the recording is performed by two or more passes (multipass) in general.

Figure 2:
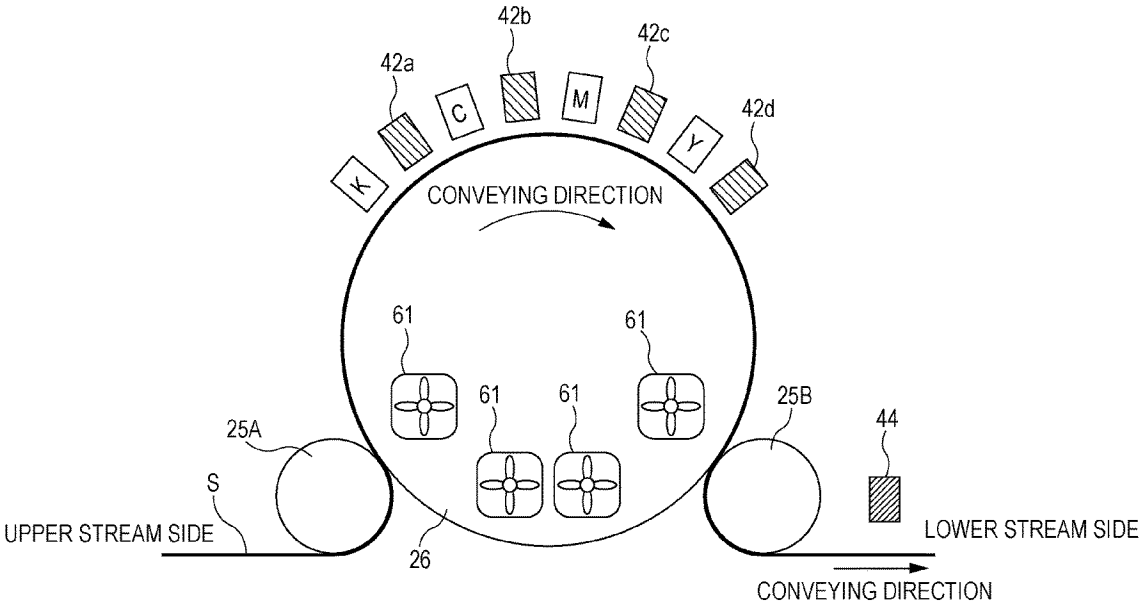
FIG. 2 is a diagram schematically illustrating an example of the periphery of a head unit, a conveying unit, and an irradiation unit in a line printer, which is an example of the ink jet apparatus of the invention.

Hereinafter, a line printer which is an example of the recording device used in the embodiment is described in detail with reference to FIG. 2. In FIG. 2 referred in the description below, scales of the respective members are appropriately changed in order to change the sizes of the respective members to be recognized.

FIG. 2 is a diagram schematically illustrating an example of the periphery of the head unit, the conveying unit, and the irradiation unit in the line printer described above, which is an example of the printer used in the embodiment.

Conveying rollers including an upstream roller 25A and a downstream roller 25B rotate by a conveying motor (not illustrated) so that a conveying drum 26 is driven. The recording medium S is conveyed along peripheral surfaces of the conveying rollers 25A and 25B and the conveying drum 26, which is a supporting body, according to the rotation of the conveying roller. Respective line heads including a head K, a head C, a head M, and a head Y are arranged in the periphery of the conveying drum 26, to face the peripheral surface of the conveying drum 26. For example, the head K is for black ink, the head C is for cyan ink, the head M is for magenta ink, and the head Y is for yellow ink.

The conveying drum 26 has a surface for conveying a recording medium S on the peripheral surface, and supports the recording medium S with the surface, and moves relatively to the heads. When the conveying drum 26 moves relatively to the heads while supporting the recording medium S, the time (cycle) until the conveying drum 26 returns to the same position from an arbitrary position is preferably 5 seconds or more, and more preferably 6 seconds or more. If the time is in the aforementioned range, the time for releasing heat from the supporting body is secured so that the increase of the temperature can be suppressed. In addition, the upper limit of the cycle is not particularly restricted, but in order to realize high speed printing, the upper limit of the cycle is, for example, preferably 15 seconds or more.

In addition, the movement in a predetermined cycle by the supporting body may be performed at least while the ink jet recording is performed, and further the movement may be continuously or intermittently performed while the ink jet recording is being performed.

The shape of the supporting body is not limited to a drum-shaped supporting body as illustrated in FIG. 2, and the shape is not particularly limited. For example, a roller-shaped or a belt-shaped supporting body, and a plate-shaped supporting body (platen or the like) for supporting the recording medium S may be included. The movement of the supporting body relatively to the heads may be the movement of returning to the same position by moving (rotating) in one direction or may be the movement of returning to the same position by combining a movement in one direction and a movement in another direction. In the latter case, a form in which the movement in the one direction is a movement of following one cut-form and the movement in the another direction is a movement of performing recording on a next recording medium after the recording on one recording medium is ended.

In addition, in the case of the serial printer, the movement to the one direction corresponds to auxiliary scanning. In addition, the movement of the supporting body relatively to the heads may be a relative movement of the supporting body to the heads, and also includes a movement of moving the heads with respect to the supporting body.

A material of the supporting body is not particularly limited. However, examples thereof include metal, resin, and rubber. Among them, metal is preferable. When the material is metal, differently from the case in which the material is a polymer material such as rubber, even if the supporting body is used for a long time, cracks which are considered as deterioration caused by heat are not generated, and long term use becomes possible. The metal is not particularly limited, and examples of the metal include aluminum, stainless steel, copper, and iron, and an alloy thereof. Further, a surface of the metal supporting body, that is, a conveying surface of the recording medium S may be coated with a coating agent. Accordingly, the solidity of the supporting body surface may be caused to be higher than that of the uncoated supporting body, and the slip between the supporting body surface and the recording medium becomes difficult. The coating agent is not particularly limited, and examples of the coating agent include an organic coating agent such as a resin, an inorganic coating agent such as an inorganic compound, and a compound coating agent thereof. In addition, the content relating to the supporting body is not limited to a line printer, and may be applied to a serial printer.

As described above, recording is performed by an ejection operation of ejecting an ink composition toward the recording medium S that faces the line heads and attaching the ink composition to the recording medium S.

As illustrated in FIG. 2, temporary curing irradiation portions 42*a*, 42*b*, 42*c*, and 42*d* are arranged on the lower stream side in the conveying direction of the line heads. The respective irradiation portions have light sources. The light sources are not particularly limited, and examples of the light sources include semiconductor light sources such as a light emitting diode (LED) including an ultraviolet light emitting diode (UV-LED) and an ultraviolet laser diode (UV-LD), metal halide light source, and a mercury lamp. Among them, a semiconductor light source having a peak wavelength in the range of 350 nm to 420 nm of the wavelength is preferable, and the LED having a peak wavelength in the range of 350 nm to 420 nm is more preferable. By using the semiconductor light source, compared with the case in which the metal halide light source or the mercury lamp is used, the recording device can be minimized, the life span thereof can be increased, the effectiveness of the ink jet recording method can be increased, and the cost thereof can be reduced. In addition, when the peak wavelength is caused to be in the range above, there is an advantage in that the curing properties are improved by the combination with the initiator used in the example and the manufacture can be performed at a lower cost than the LED having a lower peak wavelength.

In the irradiation process using the recording device, the temporary curing irradiation portions 42*a*, 42*b*, 42*c*, and 42*d* irradiate the recording medium S with ultraviolet light. In addition, a main curing irradiation portion 44 is arranged on the further lower stream side in the conveying direction, so that the recording medium S is irradiated with ultraviolet light. Such a recording device can be configured as illustrated in FIG. 11 of JPA-2010-269471.

Here, the temporary curing refers to temporary fixing (pinning) of the ink composition, and specifically to perform curing before the main curing for the prevention of the bleeding between dots and the control of the diameters of the dots. In general, the polymerization degree of the polymerizable compound in the temporary curing is lower than the polymerization degree of the polymerizable compound in the main curing performed after the temporary curing. Also, the "main curing" refers to curing dots formed on the recording medium to a cured state required for the use of the recorded matter. Here, in the specification, unless mentioned otherwise, the "curing" refers to the main curing. Plural times of ultraviolet light irradiation are preferably performed by one pass (one scanning).

In FIG. 1, the black ink receives ultraviolet light from the temporary curing irradiation portions 42*a*, 42*b*, 42*c*, and 42*d* and the main curing irradiation portion 44, the cyan ink receives ultraviolet light from the temporary curing irradiation portions 42*b*, 42*c*, and 42*d* and the main curing irradiation portion 44, the magenta ink receives ultraviolet light from the temporary curing irradiation portions 42*c* and 42*d* and the main curing irradiation portion 44, and the yellow ink receives ultraviolet light from the temporary curing irradiation portion 42*d* and the main curing irradiation portion 44.

However, the UV ink (ultraviolet curable ink composition) ejected from the heads C, M, Y, and K generates heat and is cured by the irradiation of the ultraviolet light. Therefore, the heat from the ink composition is transmitted to the conveying drum 26 via a recording medium, and increases the temperature of the conveying drum 26. Therefore, if the duration time of the process of attaching the ink composition is 20 minutes or more, the temperature of the rotating drum becomes 45° C. or higher in some cases. In such cases, even if the ink composition is prepared so that the viscosity of the ink composition in room temperature has an optimum value, the temperature of the ink composition increases by the heat of the conveying drum 26 and the viscosity thereof decreases. As described below, if the viscosity of the ink composition decreases to be less than 6 mPa·s, there is inconvenience in that wrinkles are generated at the time of curing. Therefore, in order to cool down the conveying drum 26, the printer 1 includes the cooling unit (cooling device) 50 including four ventilation fans 61 that generate air flow passing through a hollow portion of the conveying drum 26.

Figure 3:
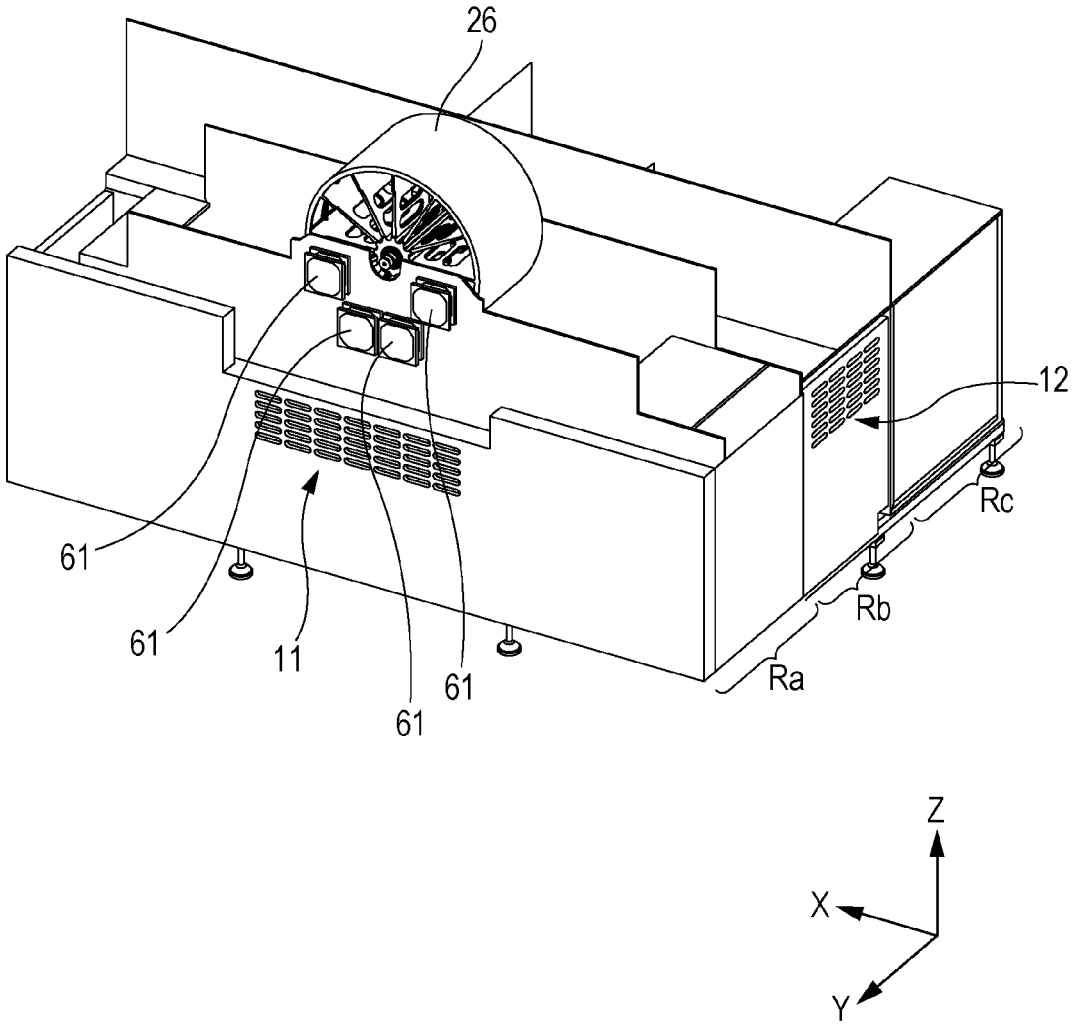
FIG. 3 is a front perspective view schematically illustrating a partial configuration of the ink jet apparatus illustrated in FIG. 1.

FIG. 3 is a front perspective view illustrating a partial configuration of the ink jet apparatus illustrated in FIG. 1. In FIG. 3, the internal configuration of the printer is illustrated, and the illustration of respective portions of the apparatus such as the head unit 30 or the recording medium S is omitted.

As clearly illustrated in FIG. 3, in the printer 1, there is a printing space Ra that forms an image on the recording medium S, a channel space Rb that is adjacent to the printing space Ra on the rearward side in a Y direction (−Y side), and a working space Rc that is adjacent to the channel space Rb on the rearward side in the Y direction (−Y side). Also, the cooling unit 50 discharges the air flow escaping the printing space Ra on which respective configurations (the conveying drum 26 and the like) illustrated in FIG. 1 are arranged in the Y direction via the channel space Rb. Specifically, the cooling unit 50 has four ventilation fans 61 provided in the forward side of the conveying drum 26 in the axis direction Y (+Y side) and six exhaust fans (not illustrated) provided in the rearward side of the conveying drum 26 in the axis direction Y (−Y side).

The respective ventilation fans 61 face the hollow portion of the conveying drum 26 in the axis direction Y. A louver 11 that faces the hollow portion on the forward side in the axis direction Y (+Y side) is formed in the housing member, and the respective ventilation fans 61 ventilate the air introduced from the outside of the printer 1 via the louver 11 to the hollow portion of the conveying drum 26. Among four of the ventilation fans 61, two of the two ventilation fans 61 in the center are arranged in a deviated manner below two of the ventilation fans 61 on both ends. In this manner, four of the ventilation fans 61 are arranged according to the shape of the hollow portion, so that the ventilation to the hollow portion can be effectively performed.

The respective exhaust fans (not illustrated) discharge the air introduced from the hollow portion of the conveying drum 26 to the outside of the printer 1 via the channel space Rb. For example, louvers 12 are provided to portions corresponding to both ends of the channel space Rb in the horizontal direction X in the printer 1, and the air discharged by the respective exhaust fans is output to the outside of the printer 1 via the louvers 12.

In this manner, the cooling unit 50 having the ventilation fans 61 and the exhaust fans (not illustrated) is provided. Therefore, inside the printer 1, the air flow in which the air escaping the hollow portion of the conveying drum 26 in the axis direction Y flows to the channel space Rb and the air flow in which the air flowing from the conveying drum 26 to the channel space Rb is discharged in the horizontal direction X are generated. That is, the air introduced from the outside of the printer 1 moves in the axis direction Y along the air flow, moves in the horizontal direction X along the air flow, and goes to the outside of the printer 1. At this point, since exhaust fans 63 in the horizontal direction X are arranged at the end of the air flow, the exchange of the air flow from one air flow to another is smoothly performed. In this manner, the exhaust fan (not illustrated) exhausts the air from the hollow portion of the conveying drum 26, and also functions as an air flow exchange fan that exchanges the air flow.

In addition, the embodiment describes an example in which the cooling unit 50 cools down the conveying drum 26 from the inside of the conveying drum 26, but the cooling unit 50 may have a configuration in which the recording medium S is cooled down by blowing the air flow from the outside of the conveying drum 26 to the recording medium S. In addition, the embodiment describes an example in which the cooling unit 50 is a gas cooling type, but the cooling unit 50 may be a liquid cooling type in which liquid is used as a cooling medium. In addition, the cooling unit 50 may be a combination type of the gas cooling type and the liquid cooling type. However, the gas cooling type is preferable since the cooling device becomes simple.

Ultraviolet Curable Ink Composition

Subsequently, the ultraviolet curable ink composition used in the ink jet recording method according to the embodiment is described. The ultraviolet curable ink composition does not contain a tri- or higher-functional polymerizable compound, but when the tri- or higher-functional polymerizable compound is contained, the content of the tri- or higher-functional polymerizable compound is 20% by mass or less.

Tri- or Higher-Functional Polymerizable Compound

The tri- or higher-functional polymerizable compound is used so that the curing properties and the antibleeding properties are improved, and the tackiness is also decreased. Meanwhile, since the crosslinking properties are higher, the preservation stability become worse, and the ejection abnormality may occur. However, according to the embodiment, if the amount of the tri- or higher-functional polymerizable compound is reduced, the curing wrinkles can be suppressed.

The tri- or higher-functional polymerizable compound is not particularly limited. However, the examples thereof include trimethylolpropane tri(meth)acrylate, EO-modified trimethylolpropane tri(meth)acrylate, pentaerythritol tri (meth)acrylate, pentaerythritol tetra(meth)acrylate, dipentaerythritol hexa(meth)acrylate, ditrimethylolpropane tetra (meth)acrylate, glycerin propoxy tri(meth)acrylate, caprolactone-modified trimethylolpropane tri(meth)acrylate, pentaerythritol ethoxy-tetra(meth)acrylate, and dipentaerythritol hexa(meth)acrylate.

The content of the tri- or higher-functional polymerizable compound is 20% by mass or lower, preferably 15% by mass or lower, and 10% by mass or lower, with respect to the total amount of the ultraviolet curable ink jet recording ink composition. If the content of the tri- or higher-functional polymerizable compound is 20% by mass or less, the preservation stability is enhanced. In addition, the tri- or higher-functional polymerizable compound may not be included. However, if the content of the tri- or higher-functional polymerizable compound is 1% by mass or higher, the curing properties and the antibleeding properties are enhanced, the tackiness is also decreased, and the generation of the wrinkles is more suppressed. Among the tri- or higher-functional polymerizable compounds, a tetrafunctional or higher-functional polymerizable compound is preferable, a pentafunctional or higher-functional polymerizable compound is more preferable, and a hexafunctional or higher-functional polymerizable compound is further more preferable. Also, a decafunctional or less-functional polymerizable compound is preferable. In such cases, in view of the above, the tri- or higher-functional polymerizable compound is more preferable as a number of a (meth)acrylate group.

Bifunctional or Less-Functional Polymerizable Compound

The ink composition may include a bifunctional or less-functional polymerizable compound having a polymerizable functional group such as a vinyl ether group, a vinyl group, a (meth)acrylate group, or the like. The polymerizable compound is not particularly limited, but the examples thereof include isoamyl (meth)acrylate, stearyl (meth)acrylate, lauryl (meth)acrylate, octyl (meth)acrylate, decyl (meth)acrylate, isomyristyl (meth)acrylate, isostearyl (meth) acrylate, 2-ethylhexyl-diglycol (meth)acrylate, 2-hydroxybutyl (meth)acrylate, butoxyethyl (meth)acrylate, ethoxy diethylene glycol (meth)acrylate, methoxy diethylene glycol (meth)acrylate, methoxy polyethylene glycol (meth)acrylate, methoxy propylene glycol (meth)acrylate, phenoxyethyl (meth)acrylate, tetrahydrofurfuryl (meth)acrylate, isobornyl (meth)acrylate, 2-hydroxyethyl (meth)acrylate, 2-hydroxypropyl (meth)acrylate, 2-hydroxy-3-phenoxypropyl (meth)acrylate, lactone-modified flexible (meth)acrylate, t-butylcyclohexyl (meth)acrylate, dicyclopentenyl (meth)acrylate, dicyclopentenyloxyethyl (meth)acrylate, 2-vinyloxyethyl (meth)acrylate, 3-vinyloxypropyl (meth) acrylate, 1-methyl-2-vinyloxyethyl (meth)acrylate, 2-vinyloxypropyl (meth)acrylate, 4-vinyloxybutyl (meth)acrylate, 1-methyl-3-vinyloxypropyl (meth)acrylate, 1-vinyloxymethylpropyl (meth)acrylate, 2-methyl-3-vinyloxypropyl (meth)acrylate, 1,1-dimethyl-2-vinyloxyethyl (meth)acrylate, 3-vinyloxybutyl (meth)acrylate, 1-methyl-2-vinyloxypropyl (meth)acrylate, 2-vinyloxybutyl (meth)acrylate, 4-vinyloxycyclohexyl (meth)acrylate, 6-vinyloxyhexyl (meth) acrylate, 4-vinyloxymethylcyclohexylmethyl (meth) acrylate, 3-vinyloxymethylcyclohexylmethyl (meth) acrylate, 2-vinyloxymethylcyclohexylmethyl (meth) acrylate, p-vinyloxymethylphenylmethyl (meth)acrylate, m-vinyloxymethylphenylmethyl (meth)acrylate, o-vinyloxymethylphenylmethyl (meth)acrylate, 2-(vinyloxyethoxy)ethyl (meth)acrylate, 2-(vinyloxy isopropoxy)ethyl (meth)acrylate, 2-(vinyloxyethoxy)propyl (meth)acrylate, 2-(vinyloxyethoxy)isopropyl (meth)acrylate, 2-(vinyloxy isopropoxy)propyl (meth)acrylate, 2-(vinyloxy isopropoxy) isopropyl (meth)acrylate, 2-(vinyloxyethoxyethoxy)ethyl (meth)acrylate, 2-(vinyloxyethoxyisopropoxy)ethyl (meth) acrylate, 2-(vinyloxy isopropoxyethoxy)ethyl (meth)acrylate, 2-(vinyloxy isopropoxyisopropoxy)ethyl (meth)acrylate, 2-(vinyloxyethoxyethoxy)propyl (meth)acrylate, 2-(vinyloxyethoxyisopropoxy)propyl (meth)acrylate, 2-(vinyloxy isopropoxyethoxy)propyl (meth)acrylate, 2-(vinyloxy isopropoxyisopropoxy)propyl (meth)acrylate, 2-(vinyloxyethoxyethoxy)isopropyl (meth)acrylate, 2-(vinyloxyethoxyisopropoxy)isopropyl (meth)acrylate, 2-(vinyloxy isopropoxyethoxy)isopropyl (meth)acrylate, 2-(vinyloxy isopropoxyisopropoxy)isopropyl (meth)acrylate, 2-(vinyloxyethoxyethoxyethoxy)ethyl (meth)acrylate, 2-(vinyloxyethoxyethoxyethoxyethoxy)ethyl (meth)acrylate, 2-(isopropenoxyethoxy)ethyl (meth)acrylate, 2-(isopropenoxyethoxyethoxy)ethyl (meth)acrylate, 2-(isopropenoxyethoxyethoxyethoxy)ethyl (meth)acrylate, 2-(isopropenoxyethoxyethoxyethoxyethoxy)ethyl (meth) acrylate, polyethylene glycol monovinyl ether (meth)acrylate, polypropylene glycol monovinyl ether (meth)acrylate, phenoxyethyl (meth)acrylate, isobornyl (meth)acrylate, benzyl (meth)acrylate, triethylene glycol di(meth)acrylate, tetraethylene glycol di(meth)acrylate, polyethylene glycol di(meth)acrylate, dipropylene glycol di(meth)acrylate, tripropylene glycol di(meth)acrylate, polypropylene glycol di(meth)acrylate, 1,4-buthanediol di(meth)acrylate, 1,6-hexanediol di(meth)acrylate, 1,9-nonanediol di(meth)acrylate, neopentyl glycol di(meth)acrylate, dimethylol-tricyclodecane di(meth)acrylate, EO (ethylene oxide) adduct di(meth)acrylate of bisphenol A, PO(propylene oxide) adduct di(meth)acrylate of bisphenol A, hydroxypivalic acid neopentyl glycol di(meth)acrylate, polytetramethylene glycol di(meth)acrylate, diethylene glycol di(meth)acrylate, triethylene glycol di(meth)acrylate, and monofunctional or bifunctional (meth)acrylate having a pentaerythritol skeleton or a dipentaerythritol skeleton.

The content of the bi- or less-functional polymerizable compound is preferably 90% by mass or less and more preferably 85% by mass or less with respect to the total amount of the ink composition. If the content of the bifunctional or less-functional polymerizable compound is 90% by mass or less, the curing properties and the antibleeding properties are enhanced, the tackiness is also decreased, and the generation of the wrinkles is more suppressed. In addition, the lower limit of the content of the bifunctional or less-functional polymerizable compound is preferably 40% by mass or greater, more preferably 50% by mass or greater, and still more preferably 60% by mass or greater, with respect to the total amount of the ink composition. If the content of the bifunctional or less-functional polymerizable compound is 40% by mass or greater, the viscosity of the ink becomes low, and the solubility of the initiator becomes excellent. In addition, among the bifunctional or less-functional polymerizable compounds, the polymerizable compound having at least one (meth)acrylate group is preferable, and as the polymerizable compound, monofunctional (meth) acrylate, bifunctional (meth)acrylate, a polymerizable compound having a (meth)acrylate group and a vinyl ether group, and the like may be included. If these are included, it is preferable in view of the above reasons.

Photoinitiator

The polymerization initiator included in the ink composition is not particularly limited, as long as the polymerization initiator generates active species such as radicals or anions by energies of light such as ultraviolet light, and causes the polymerization of the polymerizable compound to start. However, the radical polymerization initiator or the cation polymerization initiator can be used, and among them, the radical polymerization initiator is preferably used.

The photo-radical polymerization initiator is not particularly limited, but examples thereof include an acyl phosphine oxide photoinitiator, a thioxanthone photoinitiator, aromatic ketone, an aromatic onium salt compound, organic peroxide, a thio compound (thio phenyl group-containing compound, and the like), an α-aminoalkyl phenone compound, a hexaarylbiimidazole compound, a ketoxime ester compound, a borate compound, an azinium compound, a metallocene compound, an active ester compound, a compound having a carbon-halogen bond, and an alkylamine compound.

The acyl phosphine oxide photoinitiator is not particularly limited, but specifically, bis(2,4,6-trimethylbenzoyl)-phenylphosphine oxide, 2,4,6-trimethylbenzoyl-diphenyl-phosphineoxide, and bis-(2,6-dimethoxybenzoyl)-2,4,4-trimethylpentyl phosphine oxide are included. Such an acyl phosphine oxide photoinitiator easily receives oxygen inhibition, but is suitable for curing when an LED presenting long wavelength light is used.

A commercially available product of the acyl phosphine oxide photoinitiator is not particularly limited, but examples thereof include Irgacure 819 (bis(2,4,6-trimethylbenzoyl)-phenylphosphine oxide), and Darocur TPO (2,4,6-trimethylbenzoyl-diphenyl-phosphine oxide).

The thioxanthone photoinitiator is not particularly limited, but specifically, at least one selected from the group consisting of thioxanthone, diethylthioxanthone, isopropylthioxanthone, and chlorothioxanthone is preferably included. In addition, though not particularly limited, 2,4-diethylthioxanthone is preferable as the diethylthioxanthone, 2-isopropylthioxanthone is preferable as isopropylthioxanthone, and 2-chlorothioxanthone is preferable as chlorothioxanthone. If the ink composition includes such a thioxanthone photoinitiator, surface tackiness can be decreased, and particularly in the case of a thin film that easily receives oxygen inhibition, the ink surface can be cured, color mixture between dots and bleeding can be prevented, and also the curing properties, the preservation stability, and the ejection stability become more excellent. Among them, a thioxanthone photoinitiator including diethylthioxanthone is preferable. If diethylthioxanthone is included, ultraviolet light (UV light) in a wide area is more effectively converted into active species. In addition, by combining the acyl phosphine oxide photoinitiator and the thioxanthone photoinitiator, the curing process by the UV-LED becomes excellent, and the curing properties and the adhesiveness of the ink composition become more excellent.

A commercially available product of the thioxanthone photoinitiator is not particularly limited, but specifically, Speedcure DETX (2,4-diethylthioxanthone), Speedcure ITX (2-isopropylthioxanthone) (above manufactured by Lambson), KAYACURE DETX-S (2,4-diethylthioxanthone) (manufactured by Nippon Kayaku Co., Ltd.) are included.

The other photo-radical polymerization initiator is not particularly limited, but examples thereof include acetophenone, acetophenonbenzylketal, 1-hydroxycyclohexylphenylketone, 2,2-dimethoxy-2-phenylacetophenone, xanthone, fluorenone, benzaldehyde, fluorene, anthraquinone, triphenylamine, carbazole, 3-methylacetophenone, 4-chlorobenzophenone, 4,4'-dimethoxybenzophenone, 4,4'-diaminobenzophenone, Michler ketone, benzoin propyl ether, benzoin ethyl ether, benzyl dimethyl ketal, 1-(4-isopropylphenyl)-2-hydroxy-2-methylpropane-1-one, 2-hydroxy-2-methyl-1-phenylpropane-1-one, and 2-methyl-1-[4-(methylthio)phenyl]-2-morpholino-propane-1-one.

A commercially available product of the photo-radical polymerization initiator is not particularly limited, but examples thereof include Irgacure 651 (2,2-dimethoxy-1,2-diphenylethane-1-one), Irgacure 184 (1-hydroxy-cyclohexyl-phenyl-ketone), DAROCUR 1173 (2-hydroxy-2-methyl-1-phenyl-propane-1-one), Irgacure 2959 (1-[4-(2-hydroxyethoxy)-phenyl]-2-hydroxy-2-methyl-1-propane-1-one), Irgacure 127 (2-hydroxy-1-{4-[4-(2-hydroxy-2-methyl-propionyl)-benzyl]phenyl}-2-methyl-propane-1-one}, Irgacure 907 (2-methyl-1-(4-methylthiophenyl)-2-morpholinopropane-1-one), Irgacure 369 (2-benzyl-2-dimethylamino-1-(4-morpholinophenyl)-buthanone-1), Irgacure 379 (2-(dimethylamino)-2-[(4-methylphenyl) methyl]-1-[4-(4-morpholinyl)phenyl]-1-buthanone), Irgacure 784 (bis(η5-2,4-cyclopentadiene-1-yl)-bis(2,6-difluoro-3-(1H-pyrrol-1-yl)-phenyl) titanium), Irgacure OXE 01 (1.2-octanedione,1-[4-(phenylthio)-,2-(O-benzoyloxime)]), Irgacure OXE 02 (ethanone,1-[9-ethyl-6-(2-methylbenzoyl)-9H-carbazol-3-yl]-,1-(O-acetyloxime)), Irgacure 754 (mixture of oxyphenyl acetic acid, 2-[2-oxo-2-phenyl acetoxy ethoxy]ethyl ester, oxyphenyl acetic acid, and 2-(2-hydroxyethoxyl)ethyl ester) (hereinafter, manufactured by BASF SE), Speedcure TPO (hereinafter, manufactured by Lambson), Lucirin TPO, LR8893, LR8970 (hereinafter, manufactured by BASF SE), and Uvecryl P36 (manufactured by UCB).

Other photocationic polymerization initiator is not particularly limited, but examples thereof include sulfonium salt, iodonium salt.

The commercially available product of the photocationic polymerization initiator is not particularly limited, but specifically, Irgacure 250 and Irgacure 270 are included.

The photoinitiator may be used singly, or two or more types thereof may be used in combination.

The content of the photoinitiator is preferably 15% by mass or less and more preferably 10% by mass or less with respect to the total amount of the ultraviolet curable ink jet recording ink composition. If the content of the photoinitiator is 15% by mass or less, the ejection stability and the cleaning recoverability are more enhanced. In addition, the lower limit of the content of the photoinitiator is preferably 1% by mass or greater, more preferably 3% by mass or greater, and still more preferably 5% by mass or greater, with respect to the total amount of the ultraviolet curable ink jet recording ink composition. If the content of the photoinitiator is 1% by mass or greater, the curing properties are more enhanced. Particularly, if the photoinitiator contains the acyl phosphine oxide photoinitiator by the content in the aforementioned range, it is preferable in view of the above reasons.

Coloring Material

The coloring material is not particularly limited, but the examples thereof include pigments and dyes.

The inorganic pigment is not particularly limited, and examples thereof carbon black (C.I. Pigment Black 7) such as furnace black, lamp black, acetylene black, and channel black, iron oxide, and titanium oxide.

The organic pigment is not particularly limited, but examples thereof include a quinacridone-based pigment, a quinacridonequinone-based pigment, a dioxazine-based pigment, a phthalocyanine-based pigment, an anthrapyrimidine-based pigment, an anthanthrone-based pigment, an indanthrone-based pigment, a flavanthrone-based pigment, a perylene-based pigment, a diketopyrrolopyrrole-based pigment, a perinone-based pigment, a quinophthalone-based pigment, an anthraquinone-based pigment, a thioindigo-based pigment, a benzimidazolone-based pigment, an isoindolinone-based pigment, an azomethine-based pigment, and an azo-based pigment.

The pigment may be used singly, or two or more types thereof may be used in combination.

The content of the pigment is preferably 0.5% by mass to 15% by mass, and more preferably 1% by mass to 10% by mass. If the content of the pigment is in the aforementioned range, the color development becomes excellent.

The dye is not particularly limited, and an acid dye, a direct dye, a reactive dye, and a basic dye can be used. Examples of the dyes include C.I. Acid Yellow 17, 23, 42, 44, 79, and 142, C.I. Acid Red 52, 80, 82, 249, 254, and 289, C.I. Acid Blue 9, 45, and 249, C.I. Acid Black 1, 2, 24, and 94, C.I. Food Black 1 and 2, C.I. Direct Yellow 1, 12, 24, 33, 50, 55, 58, 86, 132, 142, 144, and 173, C.I. Direct Red 1, 4, 9, 80, 81, 225, and 227, C.I. Direct Blue 1, 2, 15, 71, 86, 87, 98, 165, 199, and 202, C.I. Direct Black 19, 38, 51, 71, 154, 168, 171, and 195, C.I. Reactive Red 14, 32, 55, 79, and 249, and C.I. Reactive Black 3, 4, and 35.

The dye may be used singly, or two or more types thereof may be used in combination.

In order to obtain the excellent concealing properties and the excellent color reproducibility, the content of the dye is preferably 1% by mass to 20% by mass with respect to 100% by mass of the ink composition.

Other Components

In order to satisfactorily maintain the preservation stability and the ejection stability from heads, to improve clogging, and to prevent deterioration of the ink composition, various kinds of additives such as a dispersant, a surfactant, a penetrant, a moisturizing agent, a dissolution aid, a viscosity adjusting agent, a pH adjusting agent, an antioxidant, an antiseptic, an antifungal, corrosion inhibitor, polymerization inhibitors in addition to the above (for example, p-methoxyphenol), and a chealating agent for capturing metal ions that influence on dispersion may be appropriately added to the ink composition used in the embodiment.

Viscosity of Ultraviolet Curable Ink

The viscosity of the ink composition according to the embodiment at 45° C. or lower is at least 6 mPa·s or higher. If the viscosity at 45° C. or lower is 6 mPa·s or higher and the temperature of the recording medium by using the cooling device is caused to be 45° C. or lower, the viscosity of the ultraviolet curable ink attached to the recording medium becomes 6 mPa·s or higher so that the generation of the curing wrinkles can be effectively suppressed. In addition, the ink composition according to the embodiment is preferable to have 15 mPa·s or higher of the viscosity of the ultraviolet curable composition when the ultraviolet curable composition is ejected from the ejection head. If the viscosity of the ultraviolet curable composition when the ultraviolet curable composition is ejected from the ejection head is 15 mPa·s or less, the ejection stability in the continuous printing can be secured.

The principle in which the curing wrinkles are generated is supposed as follows, but the range of the invention is not limited by the supposition. It is supposed that when the ink is coated, if the coating surface is first cured and then the inside of the coating surface is cured later than the coating surface, the curing wrinkles are generated by the deformation of the previously cured coating surface or the irregular movement of the ink inside the coating surface until the ink is cured later. Particularly, it is supposed that the curing wrinkles are easily generated in the curing method in which the ultraviolet curable ink is cured not by one time of ultraviolet light irradiation, but by plural times of ultraviolet light irradiation. In addition, in the ultraviolet curable ink of which the viscosity is low, the fluidity is high and the polymerization shrinkage accompanied by the curing (difference between mass of ink with respect to volume of ink before curing which has predetermined mass and mass of ink after curing (cured material)) tend to be great, and thus the generation of the curing wrinkles is remarkable. In addition, it is supposed that ultraviolet curable ink containing monofunctional (meth)acrylate described below, particularly, ultraviolet curable ink containing vinyl ether group-containing (meth)acrylate expressed by Expression (I) described below, tends to easily generate curing wrinkles, and in the ultraviolet curable ink that contains vinyl ether group-containing (meth)acrylate expressed by Expression (I) and has low viscosity, the generation of the curing wrinkles is remarkable. If the ultraviolet curable ink used in the ink jet recording method according to the embodiment contains the aforementioned components, the generation of the curing wrinkles can be effectively suppressed by causing the viscosity to be in the aforementioned range. In addition, as the viscosity of the specification, the value measured by the method performed by the example described below can be employed.

Here, an example of a designing method of ink for causing the viscosity of the ink to be in a desired range is described.

The mixture viscosity of the entire polymerizable compound included in the ink can be estimated by the viscosity of the respective used polymerizable compounds and the mass ratios of the polymerizable compounds with respect to the ink composition.

It is assumed that the ink include N kinds of polymerizable compounds including polymerizable compounds A, B, . . . , N. The viscosity of the polymerizable compound A is VA, and the mass ratio of the polymerizable compound A with respect to the total amount of the polymerizable compounds in the ink is MA. The viscosity of the polymerizable compound B is VB, and the mass ratio of the polymerizable compound B with respect to the total amount of the polymerizable compounds in the ink is MB. In the same manner, the viscosity of the N-th polymerizable compound N is VN, and the mass ratio of the polymerizable compound N with respect to the total amount of the polymerizable compound in the ink is MN. For confirmation, the expression of "MA+MB+ . . . +MN=1" is concluded. In addition, the mixture viscosity of the total amount of the polymerizable compound included in the ink is VX. Then, it is assumed that the following Expression (1) is satisfied.

$$MA \times \mathrm{Log}\ VA + MB \times \mathrm{Log}\ VB + \ldots + MN \times \mathrm{Log}\ VN = \mathrm{Log}\ VX \quad (1)$$

In addition, for example, if two kinds of the polymerizable compounds are included in the ink, the mass ratio of the polymerizable compound after MB is set to be zero. The number of kinds of the polymerizable compounds is an arbitrary number which is one or more.

Subsequently, the sequence (Steps 1 to 7) for causing the viscosity of the ink to be a desired range is described.

First, information on the viscosity of the respective used polymerizable compounds at a predetermined temperature is obtained (Step 1). An obtaining method includes obtaining the information from manufacturers' catalogues or the like and measuring the viscosity of the respective polymerizable compounds at a predetermined temperature, and the like. Even if the polymerizable compounds are the same, the viscosity of the respective polymerizable compounds may be different depending on the manufacturer. Therefore, the viscosity information obtained from the manufacturer of the used polymerizable compounds may be employed.

Subsequently, the composition ratios (mass ratios) of the respective polymerizable compounds are determined based on Expression (1) by setting the target viscosity to the VX, so that VX becomes the target viscosity (Step 2). The target viscosity is the viscosity of the ink composition finally obtained, and for example, the viscosity is set to be in the range of 15 mPa·s to 25 mPa·s. The predetermined temperature is set to 20° C.

Subsequently, the composition of the polymerizable compounds (hereinafter, referred to as "polymerizable composition") is prepared by actually mixing the polymerizable compounds, and the viscosity at the predetermined temperature is measured (Step 3).

Then, if the viscosity of the polymerizable composition is approximately close to the target viscosity (target viscosity±5 mPa·s in Step 4), the ink composition including the polymerizable composition and the component other than the polymerizable compounds such as a photoinitiator or a pigment (hereinafter, referred to as "components except for polymerizable compounds") is prepared, and the viscosity of the ink composition is measured (Step 4). In Step 4, if there is a component which is other than the polymerizable compounds, and for example, which is mixed with the ink composition in a form of the pigment dispersion liquid, the polymerizable compound included in the pigment dispersion liquid in advance is also introduced to the ink composition. Therefore, the ink composition has to be adjusted to a mass ratio obtained by subtracting the mass ratio of the polymerizable compound introduced to the ink composition as the pigment dispersion liquid, from the composition ratio of the respective polymerizable compounds determined in Step 2.

Subsequently, the difference between the measurement viscosity of the ink composition and the measurement viscosity of the polymerizable composition is calculated, and the difference is set to be VY (Step 5). Here, "VY>0" is satisfied in general. The VY may be different depending on the containing condition such as the kinds or the contents of the components other than the polymerizable compounds, but in the example described below, the VY was 3 mPa·s to 5 mPa·s.

Subsequently, the value "target viscosity—VY in Step 2" is determined to VX, and the composition ratios of the respective polymerizable compounds are redetermined from Expression (1) so that VX becomes "target viscosity—VY in Step 2" determined above (Step 6).

Subsequently, the ink composition is prepared by mixing the respective polymerizable compounds of the composition ratio determined in Step 6 and the components other than the polymerizable compounds, and the viscosity at the predetermined temperature is measured (Step 7). If the measured viscosity becomes to the target viscosity, the ink composition adjusted in Step 7 becomes the ink composition having the target viscosity.

Meanwhile, in Step 3, if the measurement viscosity of the composition of the prepared polymerizable compound is not in the range of "target viscosity±5 mPa·s", the fine adjustment is performed, and then the processes are performed again from Step 3. Firstly, if the measurement viscosity is too high, the fine adjustment in which the content of a polymerizable compound having a viscosity as a single component higher than the target viscosity is decreased, and the content of a polymerizable compound having a viscosity lower than the target viscosity is increased is performed. Meanwhile, if the measurement viscosity is too low, the fine adjustment in which the content of a polymerizable compound having a viscosity as a single component lower than the target viscosity is decreased, and the content of a polymerizable compound having a viscosity higher than the target viscosity is increased is performed. In addition, in Step 7, the measurement viscosity of the prepared ink composition is not the target viscosity, the adjustment in the same manner as in the fine adjustment is performed and the processes are performed again from Step 7.

Average Polymerizable Unsaturated Double Bond Equivalent Weight of Ultraviolet Curable Ink In the ultraviolet curable ink, the average polymerizable unsaturated double bond equivalent weight is preferably in the range of 50 to 200, and more preferably in the range of 120 to 150. If the average polymerizable unsaturated double bond equivalent weight is the lower limit value or greater, the reaction calorie generated by the curing is suppressed to be low. Therefore, the increase of the temperature after the continuous printing can be suppressed, and the preservation stability becomes excellent. In addition, if the average polymerizable unsaturated double bond equivalent weight is the higher limit value or lower, the curing properties become excellent.

Here, the "average polymerizable unsaturated double bond equivalent weight" in the specification can be paraphrased into an average equivalent weight of the polymerizable unsaturated double bond. The compound having the polymerizable unsaturated double bond can be a compound having the polymerizable functional group including a polymerizable unsaturated double bond, so the compound may not be limited to the below, examples thereof include a (meth)acrylate compound, a vinyl compound, a vinyl ether compound, and an allyl compound. The compound having the polymerizable unsaturated double bond may be the compound having one or more polymerizable functional groups, and if there are two or more polymerizable functional groups, the polymerizable functional groups may be the same kind, or may be different kinds of polymerizable functional groups. In addition, the respective compounds are classified into a polymerizable compound having an aromatic skeleton, a polymerizable compound having a cyclic or straight-chain aliphatic skeleton, and a polymerizable compound having a heterocyclic skeleton according to the structure other than the polymerizable functional groups.

In the specification, the average polymerizable unsaturated double bond equivalent weight of the ultraviolet curable ink can be obtained in the following manner. First, the polymerizable unsaturated double bond equivalent weight of the polymerizable compound for each polymerizable compound included in the ink is calculated by Expression (2). Polymerizable unsaturated double bond equivalent weight of polymerizable compound=molecular weight of polymerizable compound/the number of polymerizable unsaturated doubles included in molecule in polymerizable compound . . . (2)

In Expression (2), as the molecular weights of the polymerizable compounds or the numbers of polymerizable unsaturated double bonds, the values in the manufacturers' catalogues or the values calculated by a chemical constitutional formula can be employed.

Subsequently, the average polymerizable unsaturated double bond equivalent weight of the ink can be calculated by Expression (3).

Average polymerizable unsaturated double bond equivalent weight of ink=(polymerizable unsaturated double bond equivalent weight of polymerizable compound A×content of polymerizable compound A in ink+polymerizable unsaturated double bond equivalent weight of polymerizable compound B×content of polymerizable compound B in ink+ . . . +polymerizable unsaturated double bond equivalent weight of polymerizable compound n×content of polymerizable compound n in ink)/(content of polymerizable compound A in ink+content of polymerizable compound B in ink+ . . . +content of polymerizable compound n in ink) . . . (3)

Expression (3) is an expression obtained in the assumption that the ink includes n kinds of polymerizable compounds, and the "n" is an arbitrary integer which is 1 or greater. In Expression (3), the "content" indicates percent by mass with respect to the total masses of the ink.

As the average polymerizable unsaturated double bond equivalent weight of the ink is smaller, the ink has more polymerizable unsaturated double bonds. Therefore, the reaction calorie generated according to the polymerization of the ink becomes greater. Meanwhile, as the average polymerizable unsaturated double bond equivalent weight of the ink is greater, the polymerizable unsaturated double bond of the ink becomes less and the reaction calorie generated according to the polymerization of the ink becomes smaller.

Recording Medium

Examples of the recording medium include absorbable or nonabsorbable recording mediums. The ink jet recording method can be widely applied to the recording mediums having various absorbing performances, from a nonabsorbable recording medium through which penetration of the water soluble ink composition is difficult, to an absorbable recording medium through which the penetration of the ink composition is easy. However, when the ink composition is applied to the nonabsorbable recording medium, the preparation of the drying performance after the curing is performed by the irradiation with the ultraviolet light may be required.

The absorbable recording medium is not particularly limited, but examples thereof include plain paper such as electrophotographic paper through which the penetration of the ink is high, ink jet printing paper (ink jet printing paper having ink absorbing layer configured with silica particles and alumina particles and ink absorbing layer configured with hydrophilic polymer such as polyvinyl alcohol (PVA) or polyvinylpyrrolidone (PVP)), art paper used in general offset printing through which the permeability of the ink is relatively low, coated paper, and cast paper.

The nonabsorbable recording medium is not particularly limited, and the examples thereof include plastic films or plates made of polyvinyl chloride, polyethylene, polypropylene, polyethylene terephthalate (PET), metal plates made of iron, silver, copper, and aluminum, metal plates or plastic plates manufactured by depositing these various kinds of metal, and alloy plates made of stainless steel or brass.

Ink Jet Method

Subsequently, the ink jet method according to the embodiment is described. The ink jet method according to the embodiment includes a cooling process of cooling the recording medium S (attachment body) by a cooling device, a process of ejecting the ink composition (ultraviolet curable composition) by the ejection head to the recording medium S having the surface temperature of 45° C. or lower by the cooling unit 50 so as to be attached to the recording medium S, and a process of irradiating the ink composition attached to the recording medium S with ultraviolet light, so as to cure the ink composition, and at the time of the irradiation with the ultraviolet light, the viscosity of the recording medium S of the ink composition attached to the recording medium S is 6 mPa·s or greater. When the ink composition is irradiated with the ultraviolet light, the viscosity of the ink composition attached to the recording medium S is the viscosity of the ink composition which is not yet irradiated with the ultraviolet light right before the irradiation of the ultraviolet light. Since the temperature of the ink composition quickly changes to the surface temperature of the recording medium S after being attached to the recording medium S, the viscosity of the ink composition attached to the recording medium S when the ink composition is irradiated with the ultraviolet light according to the embodiment may be the viscosity of the ink composition at the surface temperature of the recording medium S in the ink composition attached to the recording medium S when the ink composition is irradiated with the ultraviolet light. Accordingly, the viscosity of the ultraviolet curable ink composition attached to the recording medium S when the ultraviolet curable ink composition is irradiated with the ultraviolet light may be the viscosity of the ultraviolet curable ink composition attached to the recording medium S at the surface temperature of the recording medium S when the ultraviolet curable ink composition is irradiated with the ultraviolet light.

Cooling Control

As described above, the ink jet method according to the embodiment includes a cooling process for controlling the surface temperature of the recording medium to be 45° C. or lower by the cooling unit 50. Particularly, it is preferable that the surface temperature of the recording medium at the first ultraviolet light irradiation, that is, when the irradiation with the ultraviolet light is performed by the temporary curing irradiation portion 42*a*, is controlled to be 45° C. or lower. As described below, in view of the control of the curing wrinkle, it is important to control the temperature and the viscosity of the ink composition attached at the first ultraviolet light irradiation. The control of the surface temperature of the recording medium S is performed by causing the detector group 110 to include a temperature sensor and causing the controller 120 to control the cooling unit 50 based on the temperature result from the temperature sensor. Specifically, the controller 120 controls the rotation number of the ventilation fan and the exhaust fan that configure the cooling unit 50 based on the temperature result from the temperature sensor.

Attachment Process

The attachment process is a process of ejecting the ink composition from the nozzle and attaching the ink composition to the recording medium. The ink jet method according to the embodiment is a method of ejecting the ultraviolet curable ink from the head to the recording medium at the ejection temperature in the predetermined range. Then, the ejection temperature is preferably 35° C. or greater, and more preferably in the range of 35° C. to 45° C.

The temperature in the range of 33° C. to 45° C. is the relatively low temperature as the temperature increased by heating. In this manner, if the temperature of the ejected ink (ejection temperature) is relatively low temperature, the irregularity of the temperature is little so that an advantage in which the ejection stability of the ink becomes satisfactory can be achieved.

Here, the ejection temperature according to the specification employs the value measured in the following method. The temperature of thermoelectric pair provided on the nozzle surface of the nozzle plate provided on the head is measured before the start of the printing, and the measured temperature is set to the ejection temperature. However, the method is not intended to limit the measurement method of the ejection temperature obtained in the invention. In addition, the ink can be caused to have a predetermined ejection temperature by arranging an ink heating device in a channel for supplying ink from the ink cartridge that contains the ink to the head and supplying the ink heated by the ink heating device.

Hereinafter, the ejection temperature is described in detail. If the corresponding temperature is 35° C. or greater, the ejection stability becomes excellent. In addition, though the ultraviolet curable ink that can be ejected at lower than 35° C. has extremely low viscosity, but there is a problem in that the curing wrinkles can be easily generated due to the low viscosity. On the contrary, the ink according to the embodiment can avoid the problem. Meanwhile, if the ejection temperature is 45° C. or lower, the increase of the temperature in the recording device can be suppressed.

The above problem is noticeable when the type of printer is line printer, and when the light source is light emitting diode (LED). Therefore, when a line printer or an LED according to the embodiment is used, particularly great effect can be achieved. In the attachment process, the line printer causes the ink jet head having a width of the nozzle row equal to or greater than the recording width of the recording medium to scan the recording medium once relatively. That is, in the line printer, the recording is performed by one pass printing. Since the line printer that performs irradiation with the ultraviolet light so that all dots are attached by one pass (one pass printing) cures a thickly applied layer at once, the line printer tends to generate curing wrinkles more easily than the serial printer that attaches dots in the adjacent pixels and performs irradiation with the ultraviolet light for each pass. Therefore, in the ink jet recording method performed by using the line printer, the invention is particularly useful.

In addition, as described above, since the ultraviolet curable ink has viscosity higher than the aqueous ink used in the general ink jet ink, the viscosity change caused by the temperature change at the time of ejection is great. The viscosity change of the ink gives great influence on the change of the liquid droplet size and the liquid droplet ejection speed, and then the image quality deterioration can be caused. Therefore, the temperature of the ejected ink (ejection temperature) is preferably maintained as stably as possible. The ejection temperature of the ink according to the embodiment can be substantially constantly maintained by causing the ejection temperature to be relatively low and adjusting the ejection temperature by heating. Accordingly, the ink according to the embodiment is excellent in the image quality stability.

In the ink jet method according to the embodiment, when the duration time of the attachment process is 20 minutes or greater, the curing is performed. The duration time refers to the duration time of one job. The ejection itself of the ink may be continuously or intermittently performed according to images. The duration time is not limited to the case of performing recording on one sheet of recording medium, and in the case of sequentially performing recording on the recording medium, the duration time refers to the total time for performing recording on all of plural sheets of the recording medium. Preferably, the attachment process time is 30 minutes or greater, more preferably in the range of 40 minutes to 100 minutes, and still more preferably in the range of 40 minutes to 70 minutes. As the duration time of the attachment process is longer, the temperature of the conveying drum 26 when the cooling device is not provided increases so that the curing wrinkle can be easily generated. According to the embodiment, even if the duration time (printing time) is long, the temperature of the conveying drum 26 can be constantly controlled so that the generation of the curing wrinkles can be suppressed.

Curing Process

The curing process is a process of curing the ink composition by irradiating the ink composition attached to the recording medium with ultraviolet light from a light emitting portion. The ink composition is cured by irradiating the ink composition attached to the recording medium with the ultraviolet light (light) from the light source. In the irradiation process, the photoinitiator included in the ink composition is degraded by the irradiation with the ultraviolet light, initiation seeds such as a radical, an acid, and a base are generated, and the polymerization reaction of the polymerizable compound is promoted by the function of the initiation seeds. Otherwise, in the irradiation process, the polymerization reaction of the polymerizable compound is initiated by the irradiation of the ultraviolet light.

The curing process includes an ultraviolet light irradiation process of temporarily curing an ink composition attached to the recording medium S and a process of performing at least one time of additional ultraviolet light irradiation in order to further cure the temporarily cured ink composition. More preferably, when the first ultraviolet light irradiation for temporary curing is performed, the viscosity of the ink composition attached to the recording medium S is 6 mPa·s or greater.

In the case of the printer 1 illustrated in FIG. 1, when the ultraviolet light irradiation is performed by the temporary curing irradiation portion 42*a*, the viscosity of the black ink attached to the recording medium S is 6 mPa·s or greater. When the ultraviolet light irradiation is performed by the temporary curing irradiation portion 42*b*, the viscosity of the cyan ink attached to the recording medium S is 6 mPa·s or greater. When the ultraviolet light irradiation is performed by the temporary curing irradiation portion 42*c*, the viscosity of the magenta ink attached to the recording medium S is 6 mPa·s or greater. When the ultraviolet light irradiation is performed by the temporary curing irradiation portion 42*d*, the viscosity of the yellow ink attached to the recording medium S is 6 mPa·s or greater. In this manner, the generation of the curing wrinkles can be suppressed by controlling the lower limit value of the viscosity of the ink when the first ultraviolet light irradiation for temporary curing is performed.

The irradiation energy of the first ultraviolet light for temporary curing is preferably in the range of 1/12 to 1/20 of the total irradiation energy of the second and subsequent ultraviolet light irradiation. By causing the ultraviolet light irradiation energy to be in the range described above, the surface curing properties become more excellent and bleeding is more suppressed.

Particularly, in FIG. 1, if the black ink is considered as a standard, the ultraviolet light irradiation performed by the temporary curing irradiation portion 42*a* corresponds to the first ultraviolet light irradiation, and the ultraviolet light irradiation performed by the temporary curing irradiation portions 42*b*, 42*c*, and 42*d* and the main curing irradiation portion 44 corresponds to the second and subsequent ultraviolet light irradiation. If the cyan ink is considered as a standard, the ultraviolet light irradiation performed by the temporary curing irradiation portion 42*b* corresponds to the first ultraviolet light irradiation, and the ultraviolet light irradiation performed by the temporary curing irradiation portions 42*c* and 42*d* and the main curing irradiation portion 44 corresponds to the second and subsequent ultraviolet light irradiation. If the magenta ink is considered as a standard, the ultraviolet light irradiation performed by the temporary curing irradiation portion 42*c* corresponds to the first ultraviolet light irradiation, and the ultraviolet light irradiation performed by the temporary curing irradiation portion 42*d* and the main curing irradiation portion 44 corresponds to the second and subsequent ultraviolet light irradiation. If the yellow ink is considered as a standard, the ultraviolet light irradiation performed by the temporary curing irradiation portion 42*d* corresponds to the first ultraviolet light irradiation, and the ultraviolet light irradiation performed by the main curing irradiation portion 44 corresponds to the second and subsequent ultraviolet light irradiation. With respect to black, cyan, magenta, yellow ink, since the first irradiation energy of the ultraviolet light for temporary curing is in the range of 1/12 to 1/20 of the total irradiation energy of the second and subsequent ultraviolet light irradiation, the curing of which the surface curing properties and the bleeding suppression are enhanced can be performed.

The lower limit of the total amount of the ultraviolet light irradiation energy in the temporary curing irradiation portions 42*a*, 42*b*, 42*c*, and 42*d* and the main curing irradiation portion 44 is preferably 100 mJ/cm$^2$ or higher, and more preferably 200 mJ/cm$^2$ or higher. In addition, the higher limit of the total amount of the ultraviolet light irradiation energy in the temporary curing irradiation portions 42*a*, 42*b*, 42*c*, and 42*d* and the main curing irradiation portion 44 is preferably 1500 mJ/cm$^2$ or lower, more preferably 1400 mJ/cm$^2$ or lower, further more preferably 1000 mJ/cm$^2$ or lower, still further more preferably 800 mJ/cm$^2$ or lower, and most preferably 600 mJ/cm$^2$ or lower. By causing the total amount of the ultraviolet light irradiation energy in the temporary curing irradiation portions 42*a*, 42*b*, 42*c*, and 42*d* and the main curing irradiation portion 44 to be in the range described above, tackiness is suppressed and the inside curing properties are more enhanced.

In this manner, according to the embodiment, it is possible to provide an ink jet recording method in which the curing properties, the ejection stability, and the suppression of the temperature increase in the recording device after the continuous printing are all excellent, and also the generation of the curing wrinkles is further suppressed. In other words, even if the recording method according to the embodiment uses the ultraviolet curable ink having low viscosity is used, the excellent curing properties and the excellent ejection stability are secured, and also the suppression of the temperature increase in the recording device after continuous printing is excellent.

In addition, according to the embodiment and example, as an example of the ink jet method and the ink jet apparatus of the invention, examples of the ink jet recording method and the ink jet recording device are described, but, for example, the invention can be applied to a three-dimensional printer. Therefore, the invention can be applied to the manufacture of all cured material, in addition to the generation of the recorded matter.

EXAMPLES

Hereinafter, the embodiment is more specifically described with reference to examples and comparative examples, but the invention is not limited to the examples.

Used Materials

Materials used in the examples and the comparative examples are as follow.

Polymerizable Compound

- VEEA (Product name of 2-(2-vinyloxyethoxyl)ethyl acrylate, manufactured by Nippon Shokubai Co., Ltd., monofunctional (meth)acrylate)
- New Frontier PHE (Product name of phenoxyethyl acrylate, manufactured by Dai-ichi Kogyo Seiyaku Co., Ltd., monofunctional (meth)acrylate, hereinafter, referred to as "PEA")
- APG-100 (Product name of dipropylene glycol diacrylate, manufactured by Shin-Nakamura Chemical Co., Ltd., bifunctional (meth)acrylate, hereinafter, referred to as "DPGDA")
- A-DPH (Product name of dipentaerythritol hexa(meth) acrylate, manufactured by Shin-Nakamura Chemical Co., Ltd., hexafunctional (meth)acrylate)

Photoinitiator

- DAROCUR TPO (Product name of 2,4,6-trimethylbenzoyl diphenylphosphine oxide, manufactured by BASF SE, hereinafter referred to as "TPO")
- IRGACURE 819 (Product name of bis(2,4,6-trimethylbenzoyl)-phenylphosphine oxide, manufactured by BASF SE, hereinafter referred to as "819")

Coloring Material

- Carbon black

Dispersant

- Solsperse 36000 (Avecia (Product name manufactured by the Lubrizol Corporation, hereinafter, referred to as "36000")

Preparation of Ultraviolet Curable Ink 1 to 12

Respective materials presented in Table 1 were added to be the contents presented in Table 1 (Unit: % by mass), and stirred by a high speed water cooling stirrer, to obtain the ultraviolet curable ink 1 to 12. In addition, the viscosities of the respective colors of ink were set to be desired values according to the viscosity designing techniques described above.

Classification of Characteristics of Ink Average Polymerizable Unsaturated Double Bond Equivalent Weight.

The average polymerizable unsaturated double bond equivalent weights of the ink were calculated by Expressions (2) and (3). The calculation results are presented in Table 1 below.

Ink Viscosity

The viscosities of the respective colors of ink at 20° C. were measured by using Physica MCR-100 (manufactured by Anton Paar GmbH).

The evaluation criteria are as follows. The evaluation results are presented in Table 1 below.

1: Less than 15 mPa·s
2: 15 mPa·s to less than 25 mPa·s
3: 25 mPa·s or greater

Curing Properties on Ink

The PET film (Product name: PET 50 (K2411) PA-T1 8LK, manufactured by Lintec Corporation) was coated with the respective colors of ink prepared as above by using a coater to obtain a coated film having a film thickness of 10 μm. Also, the ultraviolet light having the irradiation intensity of 1000 mW/cm$^2$ and the peak wavelength of 395 nm was applied by an ultraviolet light irradiation device (UV-LED) for a predetermined time to cure the respective coated films. The cured coated film (cured film) was rubbed using a cotton bud for 10 times with 100 g of weight, and the curing energy (irradiation energy) at a time point when no damage occurs was obtained.

The evaluation was performed by calculating the irradiation energy of the ultraviolet light required at the time of curing. The irradiation energy [mJ/cm$^2$] was obtained by measuring the irradiation intensity [mW/cm$^2$] on the irradiation target surface irradiated with the light source and multiplying the irradiation intensity and the irradiation duration time [s]. The measurement of the irradiation intensity was performed by using an ultraviolet intensity meter UM-10 and a light receiving unit UM-400 (all manufactured by Konica Minolta Sensing, Inc.).

The evaluation criteria are as follows. The evaluation results are presented in Table 1 below.

A: Curing is performed by irradiation energy having accumulated light amount of 200 mJ/cm$^2$ or less
B: Curing is performed by irradiation energy having accumulated light amount of greater than 200 mJ/cm$^2$ Preservation stability of ink The respective colors of ink of which the ink viscosities were measured were put into 50 mL glass bottles, and the glass bottles were tightly stopped and then put into the thermostatic chamber for 1 week at 60° C. Thereafter, the viscosities of the respective colors of ink of which the temperatures were lowered to room temperature were measured in the manner as described above. Then, the preservation stability was evaluated with the viscosity rates before or after the preservation (rate of viscosity of ink after preservation with respect to viscosity of ink before preservation).

The evaluation criteria are as follows. The evaluation results are presented in Table 1 below.

A: Viscosity rate of less than 5%

B: Viscosity rate in the range of 5% to 10%

C: Viscosity rate of greater than 10%

TABLE 1

| | Constitution 1 | Constitution 2 | Constitution 3 | Constitution 4 | Constitution 5 | Constitution 6 |
|---|---|---|---|---|---|---|
| VEEA | 20 | 20 | 30 | 40 | 70 | 75 |
| PEA | 40 | 20 | 20 | 10 | | 5 |
| DPGDA | 20 | 36 | 30 | 30 | 10 | |
| A-DPH | 8 | 12 | 8 | 8 | 8 | 8 |
| Irgacure819 | 3 | 3 | 3 | 3 | 3 | 3 |
| DarocurTPO | 5 | 5 | 5 | 5 | 5 | 5 |
| Dispersant (Solsperse 36000) | 1 | 1 | 1 | 1 | 1 | 1 |
| Carbon Black | 3 | 3 | 3 | 3 | 3 | 3 |
| Total | 100 | 100 | 100 | 100 | 100 | 100 |
| Ink viscosity rank (20° C.) | 2 | 2 | 2 | 2 | 1 | 1 |
| Curing properties | A | A | A | A | A | A |
| Preservation stability | A | A | A | B | B | B |
| Average polymerizable unsaturated double bond equivalent weight | 145 | 127 | 125 | 114 | 96 | 99 |

| | Constitution 7 | Constitution 8 | Constitution 9 | Constitution 10 | Constitution 11 | Constitution 12 |
|---|---|---|---|---|---|---|
| VEEA | 7 | 28 | 5 | 60 | 20 | 20 |
| PEA | 55 | 60 | 9 | | 17 | 20 |
| DPGDA | 26 | | 70 | | 36 | 23 |
| A-DPH | | | 4 | 28 | 15 | 25 |
| Irgacure819 | 3 | 3 | 3 | 3 | 3 | 3 |
| DarocurTPO | 5 | 5 | 5 | 5 | 5 | 5 |
| Dispersant (Solsperse 36000) | 1 | 1 | 1 | 1 | 1 | 1 |
| Carbon Black | 3 | 3 | 3 | 3 | 3 | 3 |
| Total | 100 | 100 | 100 | 100 | 100 | 100 |
| Ink viscosity rank (20° C.) | 3 | 2 | 3 | 2 | 2 | 3 |
| Curing properties | B | B | B | A | A | A |
| Preservation stability | A | A | A | C | B | C |
| Average polymerizable unsaturated double bond equivalent weight | 163 | 161 | 126 | 94 | 124 | 124 |

Printed matters were prepared by using the ink compositions having the characteristics described above according to the methods of the examples and the comparative examples. Hereinafter, the recording methods in the respective examples and respective comparative examples are described.

In the respective examples and the respective comparative example, a line printer including line heads having the length approximately corresponding to the width (recording target width) of the recording medium in which the image is to be recorded, illustrated in FIG. 2 was used. In addition, among the heads and the light sources illustrated in FIG. 2, the head K, the light source 42*a*, and the light source 44 were used, and the others were not used. As the light source 42*a*, an LED having a peak wavelength of 395 nm and the irradiation peak intensity of 500 mW/cm$^2$ was used. In addition, as the light source 44, an LED having the peak wavelength of 395 nm and the irradiation peak intensity of 1500 mW/cm$^2$ was used. The conveying drum 26 was prepared with aluminum, the diameter of the conveying drum 26 was 500 mm, the printing speed was 285 mm/s, and the drum rotation cycle was 5.5 s.

In the respective examples and the respective comparative examples, the continuous printing was performed for 20 minutes. Continuous ejection from all nozzles to a roll-shaped recording medium (PET film) conveyed on the drum was performed. The nozzle density in the head was 720 dpi. The formed patterns had the recording resolution of 720×720 dpi. One pattern was a square having the size of 5×5 cm, and the patterns were arranged in line in the horizontal and vertical directions to have spaces of 5 mm. The recording medium was Lumirror S10 manufactured by Toray Industries, Inc., and the thickness thereof was 100 μm. In addition, in the reference example, the method was performed in the same condition as in Comparative example 2 except that the duration time of the continuous printing was 10 minutes. In the reference example, a cooling mechanism was not included, and natural cooling was performed by stopping the apparatus every 10 minutes in order to maintain the temperature of the recording medium at 45° C. or lower.

Differences in printing according to the respective examples and the respective comparative examples are compositions of the used ink compositions, the average polymerizable unsaturated double bond equivalent weights, the ink heating temperatures when ejecting, viscosities of the ink compositions on the recording medium, the pinning energy (irradiation energy for temporary curing), and the main curing energy. In Table 1, the printing conditions were classified as described below. In addition, printing was performed in Examples 1 to 13 while the drum cooling mechanism was operated, and printing was performed in Comparative examples 1 to 7 while the drum cooling mechanism was operated except for Comparative example 7.

Printing Conditions of Examples and Comparative Examples

Ink Viscosity Rank (Recording Medium Temperature)

1: 10 mPa·s or greater

2: 6 mPa·s to less than 10 mPa·s

3: 6 mPa·s or less

Average Polymerizable Unsaturated Double Bond Equivalent Weight Rank

1: 100 or less

2: In the range of 100 to 150

3: Greater than 150

Ink Heating Temperature

1: Less than 35° C.

2: 35° C. to less than 40° C.

3: 40° C. or greater

Main Curing Energy

A: 250 mJ/cm$^2$

B: 300 mJ/cm$^2$

Ratio of Pinning/Main Curing Energy

A: 1/12 or greater

B: 1/120 to less than 1/12

C: Less than 1/120

Printing Condition: Drum Cooling Mechanism

In addition, printing was performed in Examples 1 to 13 while the drum cooling mechanism was operated, and printing was performed in Comparative examples 1 to 7 while the drum cooling mechanism was not operated except for Comparative example 7. In the respective examples and the respective comparative examples, printing conditions were ranked as described below based on the conditions of the operations of the cooling mechanism in the continuous printing for 20 minutes and the temperature of the recording medium. In addition, the recording medium temperatures were measured in the same condition as in the recording medium temperature stability described below.

1A: When the continuous printing for 20 minutes while the drum cooling mechanism was operated was ended, the temperature of the recording medium was 45° C. or less. (Specifically, the temperatures were different according to the examples and the comparative examples, but the temperatures were about 39° C. to 43° C.)

1B: In the same manner as in 1A, the temperature was 45° C. or less, but in order to sufficiently exposing the drums to the wind for causing the temperature to be 45° C. or less, the strength of the ventilation from the fan had to be stronger than in the case of 1A.

2: When the continuous printing for 20 minutes while the drum cooling mechanism was not operated was ended, the temperature of the recording medium was greater than 45° C. (Specifically, the temperature was between 50 and 60° C.)

3: When the continuous printing for 10 minutes while the drum cooling mechanism was not operated was ended, the temperature of the recording medium was less than 45° C.

Measurement and Evaluation Items

The ink jet method according to the examples and the comparative examples was evaluated based on the following items. In addition, in the reference example, the evaluations other than the recording medium temperature stability were performed in the condition of the continuous printing for 10 seconds.

Recording Medium Temperature Stability

The temperature of the recording medium when the continuous printing for 20 minutes was ended was measured, to evaluate whether the surface temperature of the recording medium when the continuous printing for 20 minutes was ended was maintained at 45° C. or lower. The temperature measurement of the recording medium was performed by measuring the temperature of the surface on the recording surface side of the recording medium at a position facing the head, the position which was in the center of the recording medium in the width direction, by a non-contact-type thermometer. Since the temperature of the conveying drum increases due to the heat and the reaction heat of the light source, the temperature of the recording medium increases to the temperature of the drum while the recording medium is conveyed to a position facing the head.

The evaluation criteria were as follows. The evaluation results are indicated in Table 2 below.

A: Temperature was maintained at 45° C. or lower

B: Temperature was not maintained at 45° C. or lower

Continuous Printing Stability

Whether ink droplets were normally ejected from the nozzles when the continuous printing was performed for 10 minutes was checked by observing dots of the patterns. The examination was performed on one head (the number of nozzles: 720). In addition, the reference example was an example of the continuous printing for 10 minutes.

The evaluation criteria were as follows. The evaluation results are presented in Table 2 below.

A: There was no abnormal nozzle

B: All nozzles perform ejection, but there was a nozzle in which curved flight occurred or of which an ejection amount was small.

C: There was a non-ejection nozzle.

Printed Matter Glossiness

Glossiness of the surface of the pattern which was formed last in the continuous printing was measured. In addition, the printing was performed with the ejection amount so that the thickness of the ink coated film of the cured pattern became 8 μm. The measurement of the glossiness was performed by measuring 60° glossiness based on JIS Z 8741. Since the glossiness decreases if there are curing wrinkles, the generation of the curing wrinkles was evaluated by the glossiness.

The evaluation criteria were as follows. The evaluation results are presented in Table 2 below.

A: Glossiness of 60 or greater

B: Glossiness of 50 to less than 60

C: Glossiness of less than 50

Bleeding of Printed Matter

End portions of the patterns created in the same manner as in the printed matter glossiness were visually observed. The end portions of the patterns which were not straight but disordered were considered as bleeding.

The evaluation results are presented in Table 2 below. The ranks in Table 2 are as follows.

A: There is no bleeding

B: There is bleeding

Filling of Printed Matter

The patterns created in the same manner as in the printed matter glossiness were observed with a loupe. However, the ejection amount was adjusted so that the thickness of the ink coated film became 5 μm.

The evaluation results are presented in Table 2 below. The ranks in Table 2 are as follows.

A: The texture of the recording medium was filled.

B: The texture was not filled.

TABLE 2

| | Examples | | | | | | | | | | | | |
|---|---|---|---|---|---|---|---|---|---|---|---|---|---|
| | 1 | 2 | 3 | 4 | 5 | 6 | 7 | 8 | 9 | 10 | 11 | 12 | 13 |
| Ink composition | 1 | 2 | 3 | 4 | 9 | 5 | 1 | 1 | 1 | 5 | 7 | 8 | 11 |
| Ink viscosity rank (temperature of recording target medium) | 1 | 1 | 2 | 2 | 1 | 1 | 1 | 1 | 1 | 2 | 2 | 1 | 1 |
| Drum cooling mechanism | 1A | 1A | 1A | 1A | 1A | 1B | 1A | 1A | 1A | 1B | 1A | 1A | 1A |
| Ink heating temperature rank when ejecting | 2 | 2 | 2 | 2 | 2 | 2 | 2 | 2 | 1 | 1 | 3 | 2 | 2 |
| Average polymerizable unsaturated double bond equivalent weight rank | 2 | 2 | 2 | 2 | 2 | 1 | 2 | 2 | 2 | 1 | 3 | 3 | 2 |
| Rate of pinning/main curing energy | B | B | B | B | B | B | A | C | B | B | B | B | B |
| Main curing energy | A | A | A | A | B | A | A | A | A | A | B | A | A |
| Pinning energy (mJ/cm2) | 10 | 10 | 10 | 10 | 15 | 10 | 25 | 2 | 10 | 10 | 15 | 10 | 10 |
| Recording target medium temperature stability | ○ | ○ | ○ | ○ | ○ | ○ | ○ | ○ | ○ | ○ | ○ | ○ | ○ |
| Continuous ejection stability | A | A | A | A | A | A | A | A | B | A | A | A | A |
| Glossiness of printed matter | A | A | B | B | A | A | A | A | A | A | B | A | A |
| Bleeding of printed matter | A | A | A | A | A | A | A | B | A | A | A | A | A |
| Filling of printed matter | A | A | A | A | A | A | B | A | A | A | A | A | A |

| | Comparative Examples | | | | | | | Reference |
|---|---|---|---|---|---|---|---|---|
| | 1 | 2 | 3 | 4 | 5 | 6 | 7 | Example |
| Ink composition | 5 | 1 | 5 | 6 | 10 | 12 | 6 | 1 |
| Ink viscosity rank (temperature of recording target medium) | 3 | 3 | 3 | 3 | 3 | 1 | 3 | 1 |
| Drum cooling mechanism | 2 | 2 | 2 | 2 | 2 | 2 | 1B | 3 |
| Ink heating temperature rank when ejecting | 2 | 3 | 1 | 2 | 2 | 2 | 2 | 2 |
| Average polymerizable unsaturated double bond equivalent weight rank | 1 | 2 | 1 | 1 | 1 | 2 | 1 | 2 |
| Rate of pinning/main curing energy | B | B | B | B | B | B | B | B |
| Main curing energy | A | A | A | A | A | A | A | A |
| Pinning energy (mJ/cm2) | 10 | 10 | 10 | 10 | 10 | 10 | 10 | 10 |
| Recording target medium temperature stability | X | X | X | X | X | X | ○ | X |
| Continuous ejection stability | A | A | A | A | A | C | A | A |
| Glossiness of printed matter | C | C | C | C | C | A | C | A |
| Bleeding of printed matter | A | A | A | A | A | A | A | A |
| Filling of printed matter | A | A | A | A | A | A | A | A |

From the results above, in Examples 1 to 13 in which the viscosity of the ultraviolet curable composition attached to the recording medium when the ultraviolet curable composition was ejected to the recording medium of which the surface temperature was 45° C. or lower by the cooling device and was irradiated with the ultraviolet light was 6 mPa·s or greater, it was found that the glossiness was high and the curing wrinkles were able to be sufficiently suppressed. In addition, Examples 1 to 13 were obtained evaluations better than the comparative examples in the recording medium temperature stability, the continuous ejection stability, the bleeding of the printed matter, and the filling of the printed matter.

Additional remarks of the examples and the comparative examples are as follows.

In Example 3, since the viscosity of the ink composition became low when being attached, it was considered that the curing wrinkles were partially generated to decrease the glossiness of the image.

From the result of Example 6, it was found that if the average polymerizable unsaturated double bond equivalent weight of the ink was low, the generation of the heat was great and the cooling became difficult.

In Example 10, it was expected that the glossiness became worse since the viscosity of the ink composition on the recording medium was comparatively low, but the actual result of the glossiness was satisfactory since the used ink composition included trifunctional monomers a lot.

In Example 11, differently from Example 10, the glossiness of the obtained image was decreased since trifunctional monomers were not included a lot and the viscosity of the ink composition when being attached was low.

In Comparative example 7, printing was performed while the cooling device was operated, but since the viscosity of the ink composition matter was low, the viscosity on the recording medium was low, and as a result, the glossiness of the image was deteriorated.

The entire disclosure of Japanese Patent Application No.: 2014-066937, filed Mar. 27, 2014 is expressly incorporated by reference herein.

What is claimed is:

1. An ink jet method comprising:

cooling an attachment body using a cooling device, the cooling device comprising plural ventilation fans that generate air flow passing through a hollow portion of a conveying drum, wherein at least one of the ventilation fans is set below a drum axis direction;

ejecting an ultraviolet curable composition from an ejection head to the attachment body, the attachment body having a surface temperature of 45° C. or lower; and irradiating the ultraviolet curable composition attached to the attachment body with ultraviolet light and curing the irradiated ultraviolet curable composition, wherein the ultraviolet curable composition does not contain a tri- or higher-functional polymerizable compound, or in a case where the ultraviolet curable composition contains a tri- or higher-functional polymerizable compound, a content of the tri- or higher-functional polymerizable compound is 20% by mass or less;

wherein the attachment body is conveyed along the conveying drum such that the time for the conveying drum in an arbitrary position to return to the arbitrary position is 5 seconds or more; and wherein a viscosity of the ultraviolet curable composition attached to the attachment body when being subjected to the irradiating with the ultraviolet light is 6 mPa·s or greater.

2. The ink jet method according to claim 1, wherein a duration time in the attaching of the ultraviolet curable composition is 20 minutes or greater.

3. The ink jet method according to claim 1, wherein the cooling device is at least any one of a gas cooling type or a liquid cooling type.

4. The ink jet method according to claim 1, wherein a temperature of the ultraviolet curable composition when being ejected from the ejection head is 35° C. or higher.

5. The ink jet method according to claim 1, wherein an average polymerizable unsaturated double bond equivalent weight of the ultraviolet curable composition is in a range of 50 to 200.

6. The ink jet method according to claim 1, wherein the ink jet method is performed by one time of scanning of ejecting the ultraviolet curable composition from the ejection head while changing a relative position of the attachment body to the ejection head.

7. The ink jet method according to claim 1, wherein the curing of the irradiated ultraviolet curable composition comprises:

irradiating the ultraviolet curable composition with ultraviolet light to temporarily cure the ultraviolet curable composition attached to the attachment body; and subsequently irradiating the ultraviolet curable composition with ultraviolet light at least once to further cure the temporarily cured ultraviolet curable composition, wherein a viscosity of the ultraviolet curable composition attached to the attachment body at a surface temperature of the attachment body when being firstly irradiated with ultraviolet light for the temporary curing is 6 mPa·s or greater.

8. The ink jet method according to claim 7, wherein an energy of the ultraviolet light irradiation for temporary curing is in a range of 1/12 to 1/20 of a total irradiation energy of the subsequent ultraviolet light irradiation.

9. The ink jet method according to claim 7, wherein a light source used for the ultraviolet light irradiation at least for the temporary curing is an ultraviolet light emitting diode having a peak wavelength in a range of 350 nm to 420 nm.

10. An ink jet apparatus which performs the ink jet method according to claim 1.

11. An ink jet apparatus which performs the ink jet method according to claim 2.

12. An ink jet apparatus which performs the ink jet method according to claim 3.

13. An ink jet apparatus which performs the ink jet method according to claim 4.

14. An ink jet apparatus which performs the ink jet method according to claim 5.

15. An ink jet apparatus which performs the ink jet method according to claim 6.

16. The ink jet method according to claim 1, wherein the ultraviolet curable composition does not contain a tri- or higher-functional polymerizable compound, or in a case where the ultraviolet curable composition contains a tri- or higher-functional polymerizable compound, a content of the tri- or higher-functional polymerizable compound ranges from 1% by mass or greater to 20% by mass or less.

17. The ink jet method according to claim 1, wherein a viscosity of the ultraviolet curable composition when being ejected from the ejection head is 15 mPa·s or less.

18. An ink jet apparatus which performs the ink jet method according to claim 16.

19. An ink jet apparatus which performs the ink jet method according to claim 17.

20. An ink jet method comprising:

cooling an attachment body using a cooling device, the cooling device comprising plural ventilation fans that generate air flow passing through a hollow portion of a conveying drum, wherein at least one of the ventilation fans is set below a drum axis direction;

ejecting an ultraviolet curable composition from an ejection head to the attachment body, the attachment body having a surface temperature of 45° C. or lower; and irradiating the ultraviolet curable composition attached to the attachment body with ultraviolet light and curing the irradiated ultraviolet curable composition, wherein the attachment body is conveyed along the conveying drum such that the time for the conveying drum in an arbitrary position to return to the arbitrary position is 5 seconds or more.

21. The ink jet method according to claim 20, wherein a duration time in the attaching of the ultraviolet curable composition is 20 minutes or greater.

22. The ink jet method according to claim 20, wherein a temperature of the ultraviolet curable composition when being ejected from the ejection head is 35° C. or higher.

23. The ink jet method according to claim 20, wherein the ink jet method is performed by one time of scanning of ejecting the ultraviolet curable composition from the ejection head while changing a relative position of the attachment body to the ejection head.

24. The ink jet method according to claim 20, wherein the curing of the irradiated ultraviolet curable composition comprises;

irradiating the ultraviolet curable composition with ultrviolet light to temporarily cure the ultraviolet curable composition attached to the attachment body; and subsequently irradiating the ultraviolet curable composition with ultraviolet light at least once to further cure the temporarily cured ultraviolet curable composition, wherein a viscosity of the ultraviolet curable composition attached to the attachment body at a surface temperature of the attachment body when being firstly irradiated with ultraviolet light for the temporary curing is 6 mPa·s or greater, and wherein an energy of the ultraviolet light irradiation for temporary curing is in a range of 1/12 to 1/20 of a total irradiation energy of the subsequent ultraviolet light irradiation.

25. The ink jet method according to claim 24, wherein a light source used for the ultraviolet light irradiation at least for the temporary curing is an ultraviolet light emitting diode having a peak wavelength in a range of 350 nm to 420 nm.

* * * * *